US005364299A

United States Patent [19]

Hill et al.

[11] Patent Number: 5,364,299

[45] Date of Patent: * Nov. 15, 1994

[54] SURFACE SKIMMING TOY

[75] Inventors: Peter C. Hill, Anaheim; Gary M. Saffer, Rancho Palos Verdes; Robert V. Pugh, Newhall; Ahmed Asbaghi, Hawthorne, all of Calif.

[73] Assignee: Mattel, Inc., El Segundo, Calif.

[ * ] Notice: The portion of the term of this patent subsequent to Oct. 15, 2008 has been disclaimed.

[21] Appl. No.: 827,259

[22] Filed: Jan. 29, 1992

[51] Int. Cl.[5] ..... A63H 27/00

[52] U.S. Cl. ..... 446/176; 446/61

[58] Field of Search ..... 446/176, 197, 180, 63, 446/61, 60, 48, 68, 429, 430, 64; 273/128 R, 109, 424, 428

[56] References Cited

U.S. PATENT DOCUMENTS

| | | | |
|---|---|---|---|
| 3,733,737 | 5/1973 | Goodman | 446/68 |
| 3,898,765 | 8/1975 | Lee | 446/63 |
| 3,935,664 | 2/1976 | Neuhierl | 446/61 |
| 3,945,147 | 3/1976 | Crowder | 446/61 |
| 4,411,249 | 10/1983 | Fogarty | 446/63 |
| 4,463,954 | 8/1984 | Panse | 273/424 |
| 4,507,096 | 3/1985 | Greenfield | 446/176 |
| 4,642,062 | 2/1987 | Dorffler | 446/68 |
| 4,897,065 | 1/1990 | Fertig | 446/63 |
| 5,057,050 | 10/1991 | Hill | 446/176 |

FOREIGN PATENT DOCUMENTS

| | | | |
|---|---|---|---|
| 22789 | of 1908 | United Kingdom | 446/68 |

*Primary Examiner*—Robert A. Hafer
*Assistant Examiner*—David J. Kenealy
*Attorney, Agent, or Firm*—Roy A. Ekstrand

[57] ABSTRACT

A surface skimming toy defines a generally planar base having a flat under surface. An upwardly extending fin is joined to the upper surface of the base member. In one embodiment, a lightweight aesthetically appealing body portion is supported upon the upper surface. In still further alternate embodiments, a pair of elongated upwardly extending side fins are secured to the upper surface of the planar base. The surface skimming toy is launched in close proximity to a smooth extended surface and assumes a skimming travel in close spacing to the surface while being supported upon an extremely thin layer of air flowing beneath the under surface of the skimming toy. In a further embodiment, the generally planar base defines a slightly convex curved surface and in another, a dual faceted surface forming a transverse crown portion. In a still further embodiment, a weight is supported proximate the leading edge of the body for stability of travel.

9 Claims, 5 Drawing Sheets

SURFACE SKIMMING TOY

CROSS REFERENCE TO RELATED PATENTS AND APPLICANTS

This application is related to a copending application filed Jan. 29, 1992, in the name of Gary M. Saffer, Robert V. Pugh and Ahmed Asbaghi entitled ADAPTABLE TOY LAUNCHER, and U.S. Pat. No. 5,057,050 entitled Surface Skimming Toy, filed Mar. 20, 1990 and having Ser. No. 07/495,979 both of which are assigned to the assignee of the present application and which are incorporated herein by reference.

FIELD OF THE INVENTION

This invention relates generally to gliding type toys and particularly to those supported in the air.

BACKGROUND OF THE INVENTION

Through the years, a virtually endless array of toys and amusement articles have been created to entertain and amuse children of varying ages. In addition to amusement and entertainment value, many such created articles have endeavored to also provide some educational or developmental activity for the child user. One of the more instructional types of toys and amusement articles relates to devices operating in reliance upon aerodynamic principles. Examples of such toys and amusement articles are found in model airplanes, gliders and ground effect toys. Model airplanes are well known and have acquired a great degree of sophistication to the extent that they virtually replicate a conventional powered airplane. Numerous radio control mechanisms have been provided together with reliable airframes to permit the user to virtually fly the remote controlled model plane. Similarly, gliders have been constructed for many years and provide substantial instruction and entertainment for the user. In the more sophisticated types of gliders, movable control surfaces are provided which may be set in various combinations to control the flight of the launched glider. In the final type of aerodynamic activity toy, a ground effect phenomenon is utilized. Basically, ground effects toys have heretofore relied upon a captured or trapped cushion of air beneath the ground effect toy to provide a supporting air pocket.

Practitioners in the art have endeavored to develop many such toys utilizing the above aerodynamic principles. For example, in the above-referenced U.S. Pat. No. 5,057,050 issued to Hill which is incorporated herein by reference and which sets forth a SURFACE SKIMMING TOY defining a generally planar base having a flat under surface. An upwardly extending fin is joined to the upper surface of the base member. In one embodiment, a lightweight aesthetically appealing body portion is supported upon the upper surface. In still further alternate embodiments, a pair of elongated upwardly extending side fins are secured to the upper surface of the planar base. The surface skimming toy is launched in close proximity to a smooth extended surface and assumes a skimming travel in close spacing to the surface while being supported upon an extremely thin layer of air flowing beneath the under surface of the skimming toy. U.S. Pat. No. 4,507,096 issued to Greenfield, Jr. sets forth a GROUND EFFECT TOY in which an elongated generally rectangular member is inclined at an acute angle with a surface over which the toy may be thrown. Continuously adjacent along the longitudinal edges and pending downwardly therefrom are two side skirts preferably having an acute triangular shape. In its preferred form a dorsal fin is disposed near the trailing edge of the toy. The toy is supported by ground effect air when moving forward with sufficient velocity to be supported upon a very low friction layer of air trapped within the cavity between the skirts. The trapped air leaks from beneath the lower edges of the side skirts and the trailing end of the toy to support the toy.

U.S. Pat. No. 4,249,334 issued to Goldfarb, et al. sets forth a TOY HOVERCRAFT APPARATUS in which a frame having an outwardly flaring skirt and downwardly projecting peripheral lip forms an air chamber beneath the outwardly flaring skirt. An electric motor supported centrally of the skirt rotates a fan located beneath the motor to draw air downwardly through vents in the upper portion of the skirt center and produce a pressurized air cushion in the chamber. The pressurized air cushion within the chamber flows outwardly beneath the peripheral lip while the air cushion of trapped pressurized air supports the hovercraft.

U.S. Pat. No. 3,611,622 issued to Lemelson sets forth a TOY TRACK in which a toy vehicle and toy trackway are provided. The toy vehicle is supported upon and encloses a portion of the vehicle track. An elongated chamber extends the length of the vehicle track and is coupled to a plurality of upwardly extending orifices. A supply of pressurized air is coupled to the elongated chamber to produce a plurality of air streams upwardly through the plurality of orifices. The toy vehicle is supported above the vehicle track by the upwardly directed air flowing from the orifices to produce a cushion of air between the vehicle and the track surface.

U.S. Pat. No. 4,199,142 issued to Reick sets forth TOYS AND GAMES USING SUPER-HYDROPHOBIC SURFACES in which a toy game or other play device includes a play surface coated with a super-hydrophobic material. Such materials are extremely water repellent whereby a drop of water applied thereto forms a ball which may be manipulated by a player to carry out predetermined play activities. In the alternative, a tiny vehicle or other toy having a hydrophilic coating thereon may be wetted with water and caused to skim upon the hydrophobic surface.

U.S. Pat. No. 3,923,301 issued to Myers sets forth an AMUSEMENT WATER SLIDE AND METHOD in which a method of adapting a hill to provide an amusement device corresponding to a water slide having a predetermined optional length rate of dissent and curvature is provided.

While the foregoing described toy and amusement articles have provided substantial entertainment and enjoyment, there remains a continuing need in the art for ever more improved and varied types of toys and amusement articles.

SUMMARY OF THE INVENTION

Accordingly, it is a general object of the present invention to provide an improved aerodynamic operative toy. It is a more particular object of the present invention to provide an improved aerodynamic toy which functions in close proximity to a smooth surface.

In accordance with the present invention, there is provided for use upon an extended smooth play surface, a surface skimming toy comprises: a toy body defining an upper surface, a lower surface, a front edge, a rear edge and a front-to-back center line; and a weight supported upon the body proximate the front edge and symmetrically disposed with respect to the center line; the under surface being the lowest portion of the surface skimming toy and creating a ground effect air cushion between the play surface and the under surface as the toy skims the play surface.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
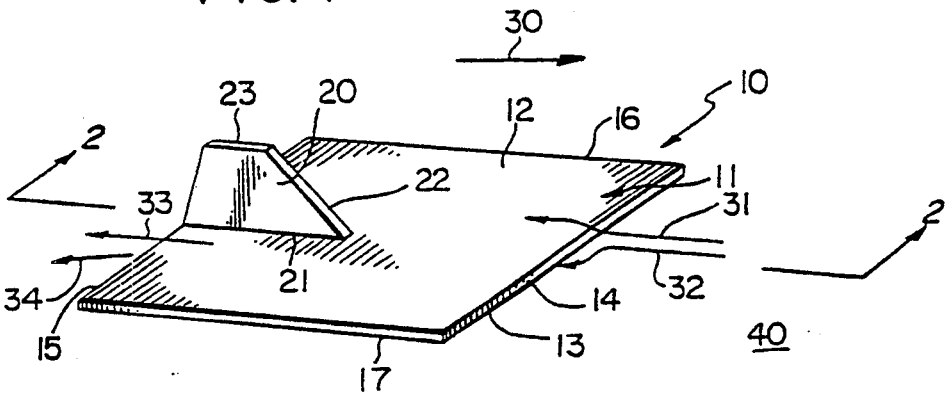
FIG. 1 sets forth a perspective view of a surface skimming toy constructed in accordance with the present invention.

FIG. 1 sets forth a perspective view of a surface skimming toy constructed in accordance with the present invention and generally referenced by numeral 10. Surface skimming toy 10 includes a thin planar generally rectangular base 11 having a planar upper surface 12 and a planar under surface 13. Base 11 further defines a front edge 14, a rear edge 15 and a pair of generally parallel side edges 16 and 17. Toy 10 further includes an upwardly extending fin 20 joined to upper surface 12 at a junction 21. Fin 20 includes an inclined leading edge 22, a horizontal top edge 23 and an inclined trailing edge 24. In accordance with the invention, toy 10 is launched in the direction indicated by arrow 30. The motion of arrow 30 through the air in proximity to a smooth surface 40 produces a relative flow of air above and below planar base 11. Thus as front edge 14 is forced through the air above surface 40, the air separates in two distinct flow streams in the manner indicated by arrows 31 and 32. The upper flow indicated by arrow 31 flows across upper surface 12 and away from base 11 as indicated by arrow 33. Conversely, the air stream flowing beneath planar base 11 indicated by arrow 32 flows across under surface 13 and away from planar base 11 in the manner indicated by arrow 34.

Figure 2:
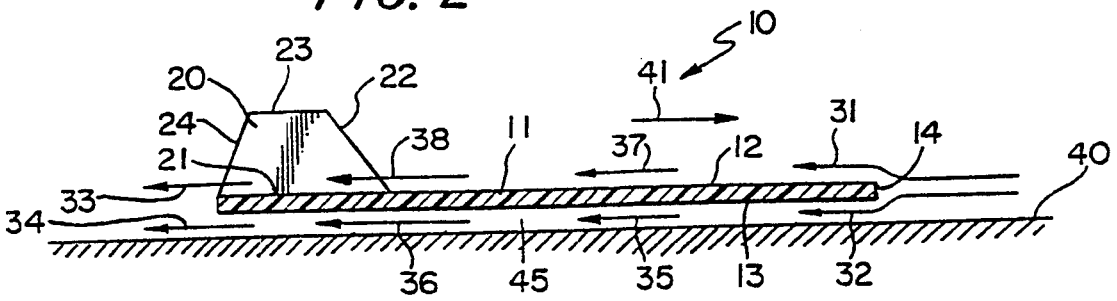
FIG. 2 sets forth a section view of the present invention surface skimming toy taken along section lines 2—2 in FIG. 1.

FIG. 2 sets forth a section view of toy 10 taken along section lines 2—2 in FIG. 1. As described above, toy 10 includes a planar base 11 having a front edge 14 and a rear edge 15. Planar base 11 further defines a planar upper surface 12 and a planar under surface 13. A vertical fin 20 is joined to upper surface 12 at junction 21 and defines an inclined leading edge 22, a horizontal top edge 23 and an inclined trailing edge 24. Toy 10 is shown moving relative to a smooth horizontal playing surface 40 in the direction indicated by arrow 41. Accordingly, the air above smooth surface 40 is divided by the intrusion of toy 10 into a first air stream indicated by arrows 32, 35, 36 and 34 and a second air stream indicated by arrows 31, 37, 38 and 33. It should be noted that, in accordance with an important aspect of the present invention, planar base 11 is maintained in close spacing with smooth surface 40 such that a uniform spacing 45 is created between under surface 13 and smooth surface 40. Thus unlike the prior art ground effect toys, toy 10 moves across smooth surface 40 in a flat parallel relationship thereto. In further departure from the prior art, it should be noted that planar base 11 defines side edges 16 and 17 which do not extend downwardly to form any side skirt members. Accordingly, toy 10 is caused to skim above smooth surface 40 without the need for an angled attitude of planar base 10 and without the need for any tunnel effect or trapped air within any underside cavity as is previously required by the prior art structure. Toy 10 relies solely upon an extremely thin layer of air between under surface 13 and smooth surface 40 to maintain toy 10 in a skimming relationship across surface 40.

It should be further noted that toy 10 is constructed without the use of any curved airfoil lift producing surfaces and is dependent solely upon the airflow beneath under surface 13 to sustain and support toy 10.

Figure 3:
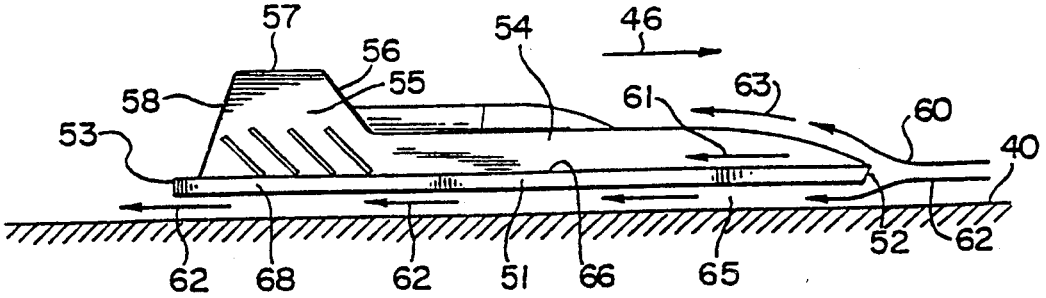
FIG. 3 sets forth a side elevation view of an alternate embodiment of the present invention surface skimming toy.

FIG. 3 sets forth an alternate embodiment of the present invention surface skimming toy generally referenced by numeral 50. Surface skimming toy 50 includes a planar base 51 having a front edge 52, a rear edge 53, an upper surface 66 and an under surface 67. In accordance with the invention, under surface 67 is generally planar. Planar base 51 further defines a side edge 68 and a side edge 69 (the latter not seen in FIG. 3). Toy 50 further includes an upwardly extending fin 55 having an inclined front edge 56, a horizontal top edge 57 and an inclined trailing edge 58. To provide improved and enhanced appearance, toy 50 further includes a futuristically styled body 54 preferably formed of a lightweight foam plastic material or the like.

In operation, toy 50 is launched across a smooth flat surface 40 in the direction indicated by arrow 46. The relative motion of toy 50 across surface 40 produces a relative airflow across toy 50 as toy 50 is driven through the air in the manner indicated by arrows 60, 61 and 62. Because planar base 51 extends outwardly from body 54 a substantial distance, the majority of airflow produced by the motion of toy 50 divides between a first air stream 62 passing beneath under surface 67 of planar base 51 and an upper airflow 61 passing across upper surface 66 of planar base 51. Additionally, a portion of the air flowing across toy 50 travels in the manner indicated by arrow 63 across the outer surfaces of body 54. Body 54 is sized and configured to provide little if any airfoil or lift action due to airflow 63 over the outer surfaces of body 54. In its preferred form of operation, toy 50 is constructed such that no airfoil action or lift is produced by airflow 63 over body 54. In its optimum design, toy 50 is intended to maintain a generally parallel attitude between planar base 51 and surface 40 as toy 50 moves across surface 40. Thus as set forth above as toy 50 is moved across surface 40, the airflow indicated by arrows 62 between surface 40 and under surface 67 of planar base 51 produces a generally constant small spacing 65 therebetween. In the event front edge 52 is raised by the aerodynamic characteristics of body 54, the performance of toy 50 is optimized by providing additional forward weight or reducing the size and curvature of body 54 until the parallel relationship between planar base 51 and surface 40 is maintained. It should be further noted that, in accordance with the present invention, side edges 68 and 69 (the latter not seen in FIG. 3) do not extend downwardly from planar base 51. Thus, planar base 51 does not .support any inclined side skirts or form any tunnel effect cavity as is required by the prior art devices set forth above to sustain its skimming action.

It will be apparent to those skilled in the art from examinations of FIGS. 1 through 3 that a variety of mechanisms and methods may be utilized to launch the present invention surface skimming toy across surface 40 and provide the above-described performance.

Figure 4:
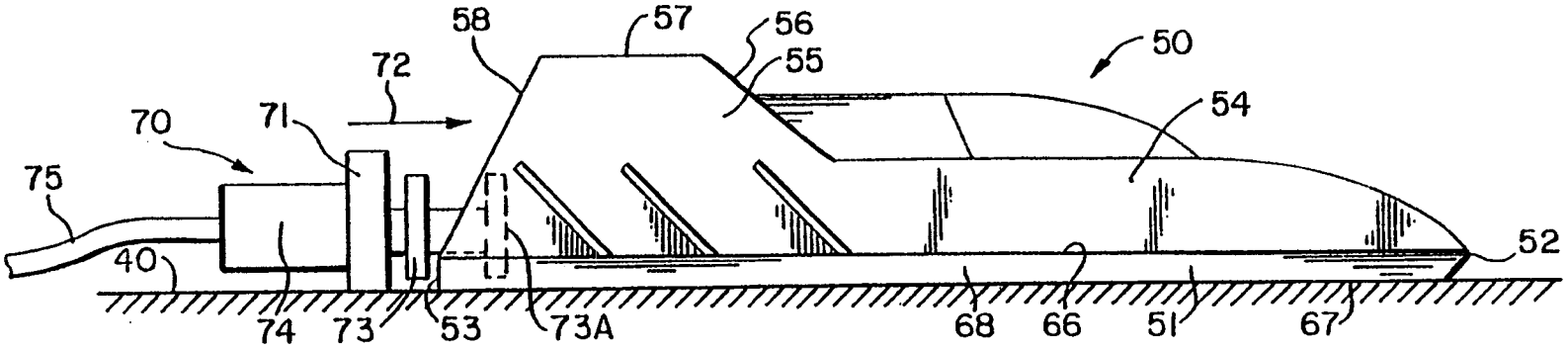
FIG. 4 sets forth the present invention surface skimming toy and air pressure launching means therefor.

FIG. 4 sets forth an exemplary configuration of an air pressure operated toy launcher. Thus toy 50, constructed as set forth above, rests upon surface 40. As is also set forth above, toy 50 includes a generally planar base 51 having an upper surface 66, an under surface 67, a front edge 52 and a rear edge 53. Planar base 51 further defines a pair of side edges 68 and 69 (the latter not seen). Toy 50 further defines a futuristically styled body 54 and an upwardly extending fin 55. Fin 55 defines an inclined leading edge 56, a horizontal top edge 57 and an inclined trailing edge 58.

An air pressure launcher 70 constructed in accordance with conventional fabrication techniques includes a support member 71 supported by surface 40, an air cylinder 74 and a movable plunger 73. Air cylinder 74 is coupled to a source of pressurized air (not shown) by an air hose 75. Plunger 73 is movably coupled to a conventional air piston (not shown) within cylinder 74. Toy 50 rests upon surface 40 such that rear edge 53 is brought into contact with plunger 73. Thereafter, a burst of pressurized air is communicated from the remote air pressure source via air hose 75 to air cylinder 74. In accordance with conventional fabrication techniques, the burst of pressurized air introduced into air cylinder 74 causes a rapid movement of plunger 73 in the direction indicated by arrow 72. The extension of plunger 73 in the direction indicated by arrow 72 is a matter of design choice. However, for purposes of illustration, it will be assumed in FIG. 4 that plunger 73 extends to the dashed line outline referenced by numeral 73A.

The sudden extension of plunger 73 produces a corresponding force against rear edge 53 of toy 50 causing toy 50 to rapidly accelerate in the direction indicated by arrow 72. The rapid acceleration of toy 50 in turn causes toy 50 to be lifted upwardly from surface 40 and assume the above-described relationship shown in FIG. 3 whereby toy 50 skims across surface 40.

Figure 5:
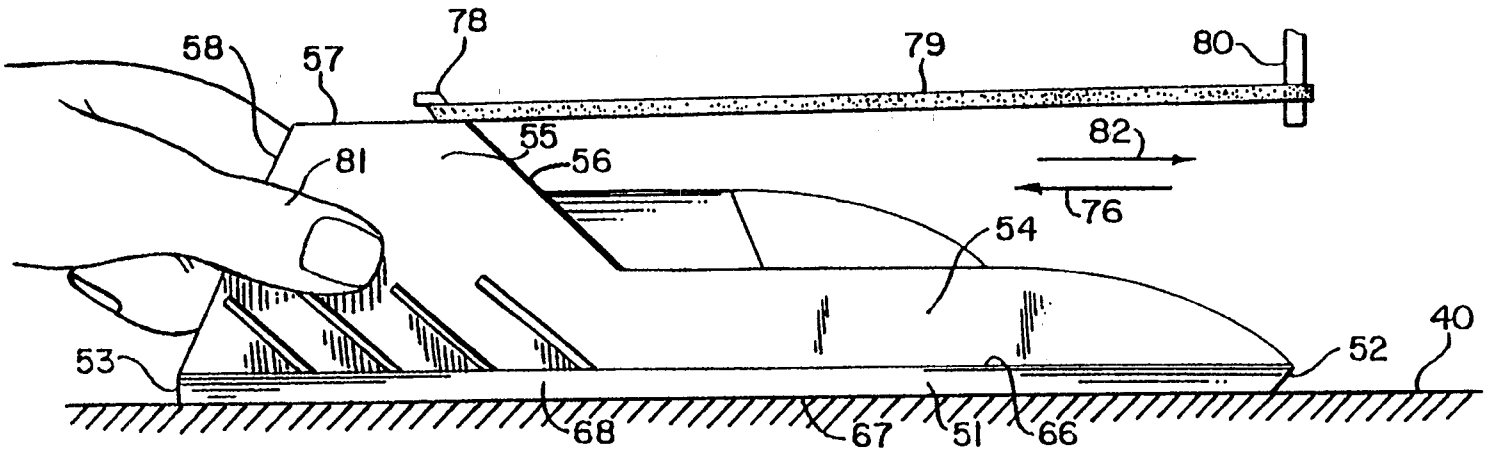
FIG. 5 sets forth an alternate launching mechanism for the present invention surface skimming toy.

FIG. 5 sets forth another example of launching mechanism which may be utilized with the present invention surface skimming toy. Toy 50, as described above, includes a generally planar base 51 having an upper surface 66, an under surface 67, a front edge 52 and a rear edge 53. Base 51 further defines a pair of side edges 68 and 69 (the latter not seen in FIG. 5). Toy 50 further includes an upwardly extending fin 55 having an inclined front edge 56, a horizontal top edge 57 and an inclined trailing edge 58. Toy 50 further includes a lightweight body 54 shaped in accordance with aesthetic preferences. A rigid hook 78 is secured to top edge 57 of fin 55. A catch 80 extends downwardly in front of toy 50 and is maintained above hook 78. Catch 80 may comprise any convenient rigid edge or surface having a fixed position with respect to surface 40. An elongated resilient rubber band 79 formed in a loop in accordance with conventional rubber band fabrication techniques encircles catch 80 and hook 78 and extends therebetween. A hand 81 grasps fin 55 in the manner shown and draws toy 50 away from catch 80 in the direction indicated by arrow 76 while maintaining the surface contact between under surface 67 of toy 50 and surface 40. The drawing motion of toy 50 in the direction indicated by arrow 76 stretches rubber band 79 and stores elastic energy therein. Once toy 50 has been drawn in the direction indicated by arrow 76 a sufficient distance to store substantial elastic energy in rubber band 79, hand 81 releases fin 55 after which the elastic energy of rubber band 79 propels toy 50 along surface 40 in the direction indicated by arrow 82. Thus, toy 50 is abruptly launched across surface 40 by the energy of rubber band 79. Once toy 50 acquires sufficient velocity with respect to surface 40, it again assumes the parallel closely spaced skimming effect set forth above in FIG. 3.

It will be apparent to those skilled in the art that, while FIGS. 4 and 5 show exemplary methods and mechanisms for launching the present invention surface skimming toy, additional means and apparatus may be utilized without departing from the spirit and scope of the present invention. It should be further noted that because the present invention surface skimming toy shown in FIGS. 1 through 5 does not utilize an angled under surface or trapping cavity or downwardly extending side skirts, the present invention surface skimming toy is not limited to operation in a forward direction. Accordingly, FIGS. 6 and 7 set forth perspective views of further alternate embodiments of the present invention surface skimming toy being launched in directions other than the straight ahead directions set forth above.

Figure 6:
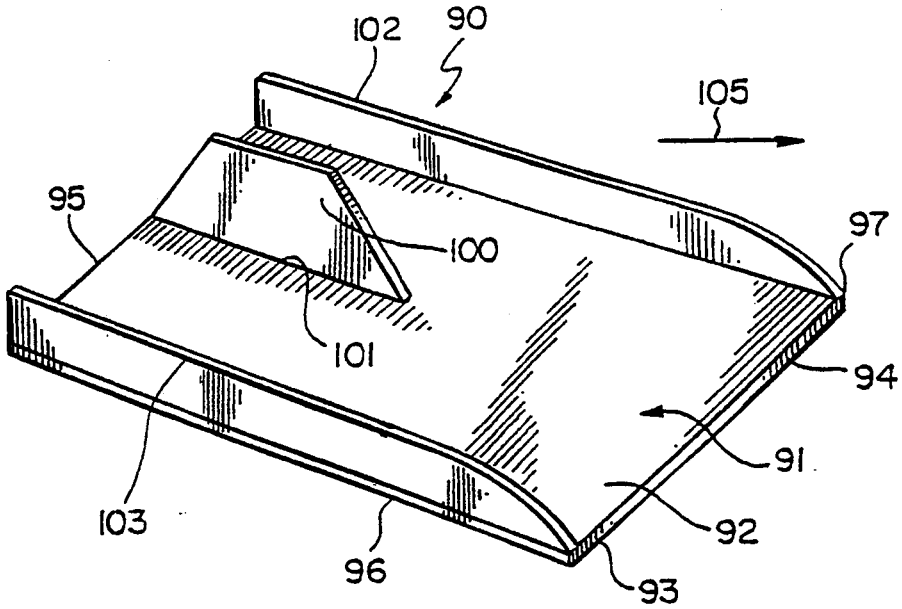
FIG. 6 sets forth a perspective view of an alternate embodiment of the present invention surface skimming toy.

FIG. 6 sets forth an alternate embodiment of the present invention surface skimming toy generally referenced by numeral 90. Toy 90 includes a generally planar base 91 having an upper surface 92 and an under surface 93. Base 91 further defines a front edge 94, a rear edge 95 and side edges 96 and 97. A vertical fin 100 extends upwardly from base 91 and is joined thereto at a junction 101. A pair of elongated side fins 102 and 103 extend upwardly from upper surface 92 of base 91. Surface skimming toy 90 may be launched in the straight ahead orientation set forth above in FIGS. 1 through 5. Alternatively, however, and in accordance with an important aspect of the present invention, toy 90 may be launched in a direction such as that indicated by arrow 105 which is not in front to back alignment with toy 90. Thus for increased entertainment and amusement value, toy 90 may be launched in an angular manner and will nonetheless assume the surface skimming characteristic set forth above for surface skimming toys 10 and 50. To further enhance the amusement and educational value of the present invention surface skimming toy, the configurations of side fins 102 and 103 as well as fin 100 interact with the airflow relative to toy 90 caused by its motion in the direction indicated by arrow 105 and tend to cause toy 90 to align with the direction of travel. In the event toy 90 is launched in other directions other than that indicated by arrow 105, a variety of interactions between fins 102 and 103 and fin 100 produce still further characteristics of operation. All, however, are accompanied by the above-described surface skimming effect.

Figure 7:
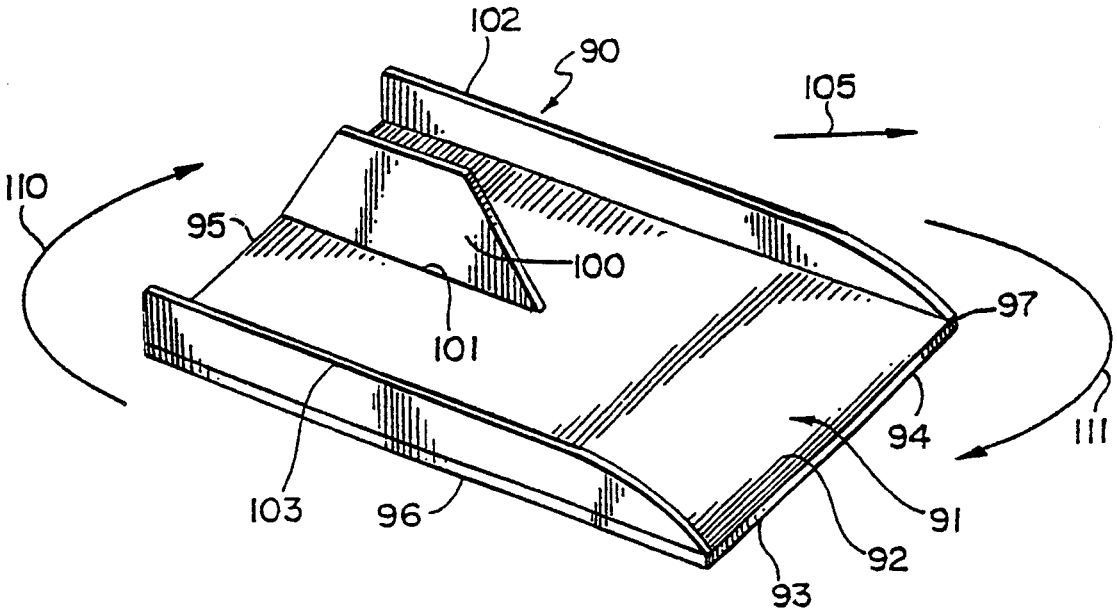
FIG. 7 sets forth a perspective view of the alternate embodiment of the present invention surface skimming toy shown in FIG. 6.

FIG. 7 sets forth a still further alternative operation of toy 90 in which toy 90 is launched in the direction indicated by arrow 105 while being simultaneously spun in the manner indicated by arrows 110 and 111. Thus in further accordance with the advantages of the present invention structure, toy 90 may assume the above-described skimming operation while moving across surface 40 and while spinning and travelling in the direction of launch such as the direction indicated by arrow 105.

Figure 8:
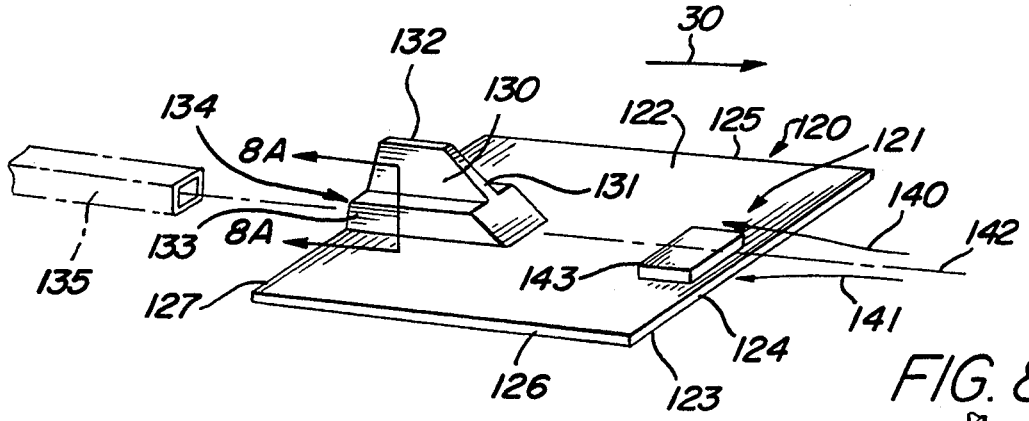
FIG. 8 sets forth a perspective view of a further alternate embodiment of the present invention surface skimming toy.

FIG. 8 sets forth a perspective view of a surface skimming toy constructed in accordance with the present invention and generally reference by numeral 120. Surface skimming toy 120 includes a generally planar base 121 having an upper surface 122 and a lower surface 123. Base 121 defines a center line 142 in the front to back direction and defines a front edge 124, a pair of side edges 125 and 126 and a rear edge 127. Toy 120 further includes a generally rectangular cross-section launcher receptacle 133 preferably formed in an integral fashion with base 121. A generally planar vertical fin 130 extends upwardly from launcher receptacle 133 and defines a leading edge 131 and a top edge 132. As is better seen in FIG. 8A, launcher receptacle 133 further defines a generally rectangular launcher tube passage 134. A weight 143, preferably formed of a metal material or the like, is positioned near front edge 124 and is symmetrically placed with respect to center line 142.

Base 121, weight 143, launcher receptacle 133 and fin 130 are all generally symmetrically disposed along center line 142.

Figure 8A:
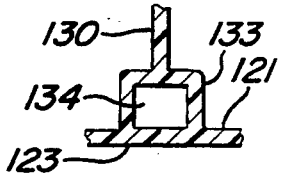
FIG. 8A sets forth a section view of the present invention surface skimming toy taken along section lines 8A—8A in FIG. 8.

With temporary reference to FIG. 8A, it should be noted that receptacle 133 defines a rectangular cross-section passage 134 which is generally symmetrical with the center of fin 130 and which is disposed generally above base 121. In its anticipated use, passage 134 may receive a correspondingly shaped launcher tube such as that set forth in the above-referenced copending related application for ADAPTABLE TOY LAUNCHER and which is indicated in dashed line outline and referenced by numeral 135. In operation, launcher receptacle 133 receives a rectangularly shaped launcher tube such as launcher tube 135 within passage 134 of launcher receptacle 133. Thereafter, a burst of pressurized air is applied to launcher receptacle 133 driving skimming toy 120 in the direction indicated by arrow 30. As skimming toy 120 is launched in the direction of arrow 130, the air flow relative to skimming toy 120 is parted along front edge 124 to produce a stream of air 140 passing along upper surface 122 and a stream of air passing beneath front edge 124 along lower surface 123. As skimming toy 120 moves across the underlying surface, the ground effect air beneath lower surface 123 is interposed between the underlying surface across which skimming toy 120 is moving and lower surface 123 of toy 120. As a result, a ground effect cushion is produced which tends to maintain skimming toy 120 in a virtually frictionless travel across the underlying surface.

In accordance with an important aspect of the present invention, the position of weight 143 at the front portion of base 121 and in a symmetrical disposition with respect to center line 142 tends to maintain a straight travel path direction for skimming toy 120. In addition, the symmetrical distribution of launcher receptacle 133 and fin 130 along center line 142 further enhances the straight line travel provided by skimming toy 120.

It will be apparent to those skilled in the art that while skimming toy 120 is preferably launched in the manner set forth in the above-described related application, toy 120 may be used in combination with virtually any available toy launcher which will impart kinetic energy to skimming toy 120 and drive it across a play surface.

Figure 9:
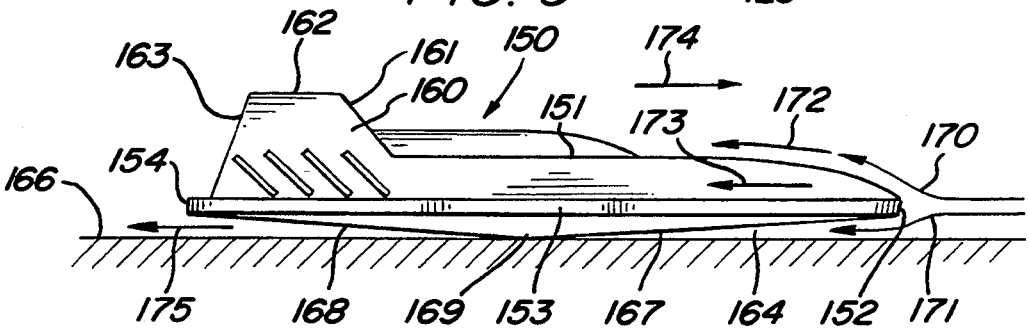
FIG. 9 sets forth a side elevation view of a still further alternate embodiment of the present invention surface skimming toy.

FIG. 9 sets forth a side elevation view of an alternate embodiment of the present invention surface skimming toy generally referenced by numeral 150. Toy 150 is preferably formed of a light molded plastic material and defines a generally convex body 151 having a front edge 152, a side edge 153 and a rear edge 154. Body 151 further defines a vertically extending fin 160 having a leading edge 161, a top edge 162 and a trailing edge 163. Toy 150 further defines an under surface having an angled front facet 167 and an angled rear facet 168 joined at a crown 169. In their preferred form, facets 167 and 168 are generally planar and extend from front edge 152 and rear edge 154 respectively to join at crown 169. Crown 169 extends generally transverse to the direction of travel indicated by arrow 174 of toy 150.

Toy 150 is shown disposed above a generally flat play surface 166.

In operation, as toy vehicle 150 is launched across play surface 166 using any of the above-described or referenced launching mechanisms, toy vehicle 150 travels through the air above surface 166. As the air above surface 166 is penetrated by toy vehicle 150, the air is divided into an upper stream 170 and a lower stream 171. Upper stream 170 tends to flow generally across body 151 in the manner shown by arrows 172 and 173. Meanwhile, the portion of air traveling beneath toy vehicle 150 indicated by arrow 171 encounters angled facet 167 and produces a ground effect tending to become intensified closer to crown 169. The underside air stream passes beneath crown 169 and across facet 168 exiting beneath rear edge 154. It has been found that the use of angled facets 166 and 167 and crown 169 for the under surface of the present invention surface skimming toy enhances the travel distance and air cushion effect substantially while reducing the friction imposed upon the toy vehicle. Thus, crown 169 tends to provide a low friction contact point in the event toy 150 makes contact with surface 166. The provision of this low friction contact greatly extends the travel distance of toy 150. While not shown in FIG. 9, it will be apparent to those skilled in the art that toy 150 may be equipped with a front edge stabilizing weight such as weight 143 shown in FIG. 8 to further enhance the directional characteristics of toy 150.

Figure 10:
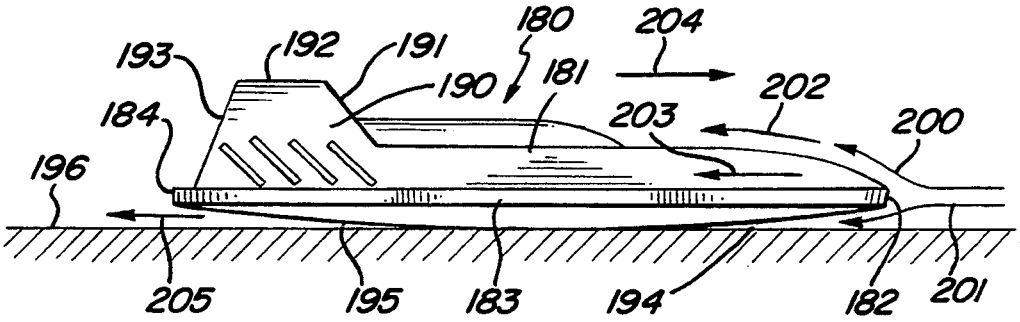
FIG. 10 sets forth a side elevation view of an additional further embodiment of the present invention surface skimming toy.

FIG. 10 sets forth a side elevation view of an alternate embodiment of the present invention surface skimming toy generally referenced by numeral 180. Toy 180 is preferably formed of a light molded plastic material and defines a generally convex body 181 having a front edge 182, a side edge 183 and a rear edge 184. Body 181 further defines a vertically extending fin 190 having a leading edge 191, a top edge 192 and a trailing edge 193. Toy 180 further defines an under surface having an angled front facet 197 and an angled rear facet 198 joined at a crown 199. In their preferred form, facets 197 and 198 are generally planar and extend from front edge 182 and rear edge 184 respectively to join at crown 199. Crown 199 extends generally transverse to the direction of travel indicated by arrow 204 of toy 180.

Toy 180 is shown disposed above a generally flat play surface 196.

In operation, as toy vehicle 180 is launched across play surface 196 using any of the above-described or referenced launching mechanisms, toy vehicle 180 travels through the air above surface 196. As the air above surface 196 is penetrated by toy vehicle 180, the air is divided into an upper stream 200 and a lower stream 201. Upper stream 200 tends to flow generally across body 181 in the manner shown by arrows 202 and 203. Meanwhile, the portion of air traveling beneath toy vehicle 180 indicated by arrow 201 encounters angled facet 197 and produces a ground effect tending to become intensified closer to crown 199. The underside air stream passes beneath crown 199 and across facet 198 exiting beneath rear edge 184. It has been found that the use of angled facets 196 and 197 and crown 199 for the under surface of the present invention surface skimming toy enhances the travel distance and air cushion effect substantially while reducing the friction imposed upon the toy vehicle. Thus, crown 199 tends to provide a low friction contact point in the event toy 180 makes contact with surface 196. The provision of this low friction contact greatly extends the travel distance of toy 180. While not shown in FIG. 10, it will be apparent to those skilled in the art that toy 180 may be equipped with a front edge stabilizing weight such as weight 173 shown in FIG. 8 to further enhance the directional characteristics of toy 180.

Figure 11:
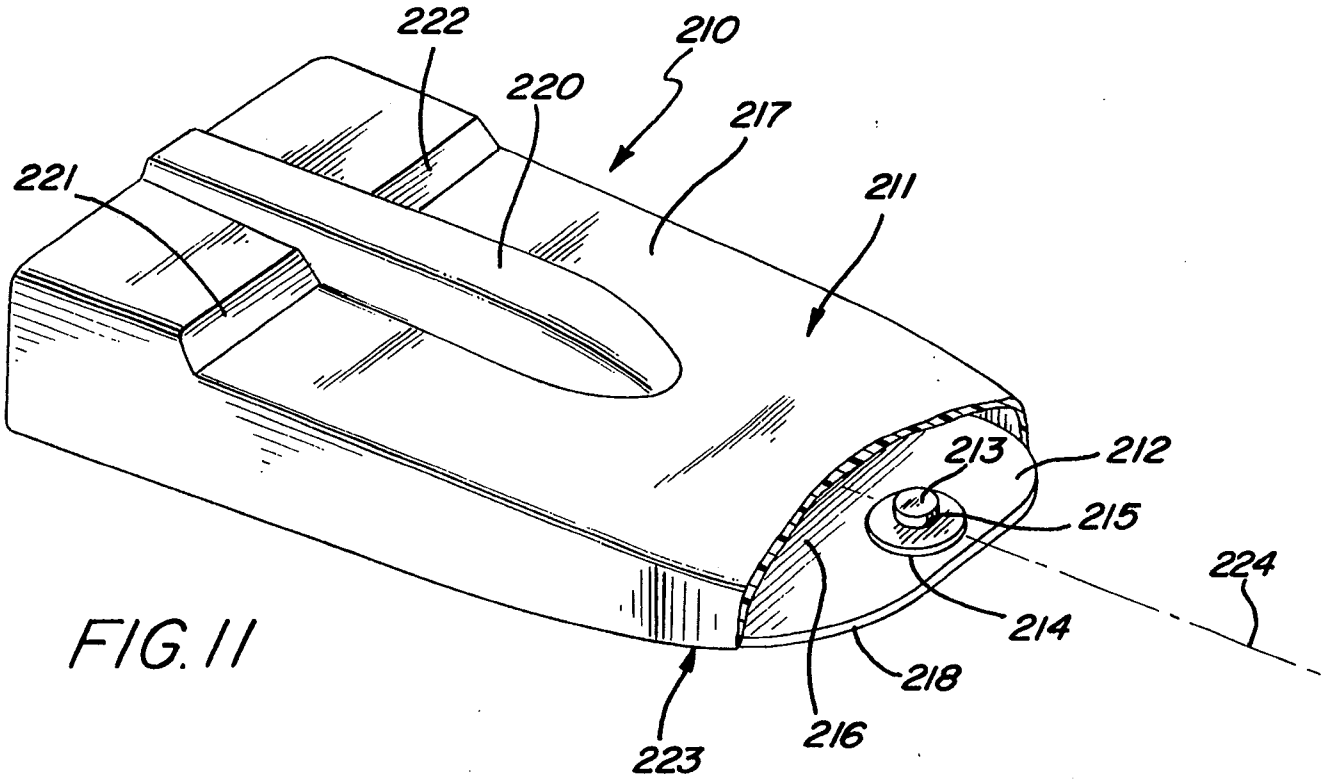
FIG. 11 sets forth a perspective view of an additional further embodiment of the present invention surface skimming toy.

FIG. 11 sets forth a perspective view of a surface skimming toy vehicle constructed in accordance with the present invention and generally referenced by numeral 210. Toy vehicle 210 includes a hollow body 211 defining an upper surface 217 and an interior cavity 216. Body 211 further defines a plurality of aesthetic features 220, 221 and 222 which provide aesthetic appeal for toy vehicle 210. Toy vehicle 210 further includes a generally planar base member 212 having an under surface 223 and defining a center line 224 about which base member 212 is generally symmetrical. Base member 212 further includes an upwardly extending generally cylindrical post 213 positioned near leading edge 218 of base member 212 and symmetrically disposed with respect to center line 224. In accordance with an important aspect of the present invention, an annular weight 214 defining a center aperture 215 is received upon post 213 and generally rests upon base member 212. In its preferred form, weight 214 is formed of a heavy material such as metal and is symmetrically disposed with respect to center line 224. Weight 214 may be maintained in place using a conventional adhesive attachment or, alternatively, the upper portion of post 213 may be deformed or bulged outwardly by conventional fabrication means such as heating, welding or staking to captivate weight 214 in place.

The use of hollow body 211 forms interior cavity 216 above base member 212 and greatly reduces the weight of toy vehicle 10. Thus, toy vehicle 10 performs in accordance with surface skimming ground effect cushion travel operation described above. The use of weight 214 in toy vehicle 210 functions in a similar manner to that set forth above in skimming toy 120 shown in FIG. 8. Thus, the additional weight provided by weight 214 near leading edge 218 stabilizes the travel of toy vehicle 210 and maintains the front to back orientation required for stable surface skimming travel.

Under surface 223 defines a generally planar surface which provides the above-described ground effect air cushion for toy vehicle 210. Alternatively, under surface 223 may be fabricated in accordance with the embodiments shown in FIGS. 9 or 10.

Thus, it will be apparent to those skilled in the art that the above-described embodiments of the present invention surface skimming toy permit a variety of activities which are not achievable by the previously provided ground effect toys, gliders or the like. It will be equally apparent to those skilled in the art that additional shapes and configurations of the present invention surface skimming toy may be created without departing from the spirit and scope of the present invention.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use upon an extended smooth play surface, a surface skimming toy comprising:

a toy body defining a front edge, a rear edge, a front-to-back center line, a lower base portion having a lower surface, a hollow convex upper portion having an upper surface, said upper surface and said lower surface being joined in such a manner as to from a cavity between said lower base portion and said upper portion;

a weight supported upon said lower base portion of said body proximate said front edge and symmetrically disposed with respect to said center line; and means for causing said surface skimming toy to assume a skimming travel when launched across a playing surface in which said lower surface is generally parallel to and closely spaced from the play surface, said means for causing including said body defining a generally flat planar surface for said undersurface.

2. A surface skimming toy as set forth in claim 1 wherein said base portion defines an upwardly extending post and wherein said weight defines an aperture receiving said post to position said weight.

3. For use upon an extended smooth play surface, a surface skimming toy comprising:

a toy body defining an upper surface, an under surface, a front edge, a rear edge, a front-to-back center line, a closed end launcher receptacle symmetrical with respect to and aligned with said center line, said launcher receptacle defining a noncircular cross-sectional closed end passage for receiving a launcher tube;

a weight supported upon said body proximate said front edge and symmetrically disposed with respect to said center line; and means for causing said surface skimming toy to assume a surface skimming travel when launched across a playing surface, said means for causing including said under surface of said toy body which defines a pair of planar portions extending downwardly from said front and rear edges to form a crown extending transverse to said center line near the midpoint between said front and rear edges for creating a ground effect air cushion between said play surface and said under surface as said toy skims said play surface.

4. A surface skimming toy as set forth in claim 3 wherein said body includes a lower base portion, a hollow convex upper portion, and a cavity therebetween and wherein said weight is supported upon said base portion within said cavity.

5. For use upon an extended smooth play surface, a surface skimming toy comprising:

a toy body defining an upper surface, a downwardly convex under surface, a front edge, a rear edge, a front-to-back center line, a closed end launcher receptacle symmetrical with respect to and aligned with said center line, said launcher receptacle defining a noncircular cross-sectional closed end passage for receiving a launcher tube;

a weight supported upon said body proximate said front edge and symmetrically disposed with respect to said center line; and means for causing said surface skimming toy to assume a skimming travel when launched across a playing surface, said means for causing including said under surface of said toy body creating a ground effect air cushion between said play surface and said under surface as said toy skims said play surface.

6. A surface skimming toy as set forth in claim 5 wherein said convex surface defines a generally cylindrically curved surface.

7. A surface skimming toy as set forth in claim 6 wherein said body includes a lower base portion, a hollow convex upper portion, and a cavity therebetween and wherein said weight is supported upon said base portion within said cavity.

8. A surface skimming toy as set forth in claim 7 wherein said base portion defines an upwardly extending post and wherein said weight defines an aperture receiving said post to position said weight.

9. A surface skimming toy as set forth in claim 4 wherein said base portion defines an upwardly extending post and wherein said weight defines an aperture receiving said post to position said weight.

* * * * *